US005829297A

United States Patent [19]

Ohkubo

[11] Patent Number: 5,829,297

[45] Date of Patent: Nov. 3, 1998

[54] PRESS APPARATUS FOR FORMING GEAR TEETH

[75] Inventor: Mamoru Ohkubo, Neyagawa, Japan

[73] Assignee: Exedy Corporation, Neyagawa, Japan

[21] Appl. No.: 929,726

[22] Filed: Sep. 15, 1997

Related U.S. Application Data

[63] Continuation-in-part of Ser. No. 659,851, Jun. 7, 1996, Pat. No. 5,709,118.

[51] Int. Cl.[6] ..... B21D 9/08; B21D 15/00; B21D 17/10

[52] U.S. Cl. ..... 72/213; 72/207; 72/208; 29/893.32

[58] Field of Search ..... 72/207, 208, 212, 72/213, 178, 352, 353.2; 29/893.3, 893.32, 893.34

[56] References Cited

U.S. PATENT DOCUMENTS 3,729,970 5/1973 Propach et al. ..... 72/208

5,447,048 9/1995 Tanaka et al. ..... 29/893.34

FOREIGN PATENT DOCUMENTS 2829-041 1/1980 Germany ..... 72/213

3629270 3/1987 Germany ..... 72/212

59-113935-A 6/1984 Japan ..... 72/213

*Primary Examiner*—Joseph J. Hail, III

*Assistant Examiner*—Rodney Butler

*Attorney, Agent, or Firm*—Shinjyu An Intellectual Property Firm

[57] ABSTRACT

A gear teeth forming apparatus is used for forming a plurality of gear teeth on an outer circumferential wall of a pressed drum. The apparatus includes a die and a plurality of rotational rollers. A plurality of convex/concave portions are formed in the axial direction on the die. The die has an outer circumferential surface on which the outer circumferential wall of the pressed drum is fitted. Also, the die is movable in the axial direction. A plurality of the rotational rollers are insertable partially into grooves of the die and are rotatable along the grooves.

13 Claims, 6 Drawing Sheets

PRESS APPARATUS FOR FORMING GEAR TEETH

This application is a continuation-in-part of application Ser. No. 08/659,851, filed Jun. 7, 1996, now U.S. Pat. No. 5,709,118

BACKGROUND OF THE INVENTION

A. Field of the Invention

The present invention relates to a gear teeth forming apparatus, and more particularly to an apparatus for forming a plurality of gear teeth which extend in an axial direction on an outer circumferential wall of a cylindrically shaped member.

B. Description of Related Art

In some applications, a drum used in a clutch assembly is often provided with a plurality of gear teeth which extend axially on an outer surface of the drum. Spline teeth of a drive plate or a driven plate in the clutch typically engage the gear teeth formed in the drum so that the plate is movable in an axial direction with respect to the drum but is engaged with the formed gear teeth on the drum for rotation with the drum.

There are many devices that form gear teeth on a drum or a metallic blank. For instance, hobbers are well known for systematically scrapping portions of a metal blank away to form gear teeth. Hobbers typically machine metal ridges in a metallic blank to form the gear teeth. There are also machines which use a cam for indexing a gear shaping tool to form gear teeth. Further, there are also cold rolling devices which use dies and, under pressure, deform a metallic blank to form gear teeth. Such cold rolling devices are often bulky and require repeated motion to deform the blank to form gear teeth.

Hobbers and cam operated devices use gear cutting tools that are too large in physical dimensions to adequately form the teeth desired on a drum in a small clutch assembly. Further, after using the cutting process which forms the gear teeth, typically a surface hardening technique must be employed to harden the gear teeth to improve wear. Therefore, the overall process is complicated and costly. Furthermore, in many other gear forming methods, the apparatus required for the gear forming operation is large and cumbersome.

SUMMARY OF THE INVENTION

An object of the present invention is to provide a gear teeth forming apparatus for a drum with a simple structure and which facilitates a simple process for producing the required gear teeth.

In accordance with one aspect of the present invention, a gear teeth forming apparatus for forming a plurality of gear teeth extending in an axial direction on an outer circumferential wall of a cylindrically shaped member includes a base member. A die is disposed above the base member. The die is supported for reciprocal movement downward toward the base member and upward away from the base member. The die is formed with a plurality of grooves on an outer circumferential surface thereof. A plurality of rollers are supported on the base and are freely rotatable with respect to the base, the rollers disposed adjacent to the outer circumferential surface of the die, each of the rollers disposed adjacent to a corresponding one of the grooves. An annular ring is supported on the base which contacts a radial outer side of each of the rollers. The annular ring is configured for reciprocal movement with respect to the base. A lever mechanism is supported on the base member mechanically connecting the annular ring and the die such that in response to movement of the die in a first direction relative to the base member. The lever mechanism moves the annular ring in an opposite direction.

Preferably, the lever mechanism is mechanically connecting the annular ring and the die such that in response to movement of the die in an upward direction with respect to the base member the annular ring is moved in a downward direction and in response to movement of the die in a downward direction the annular member is moved in an upward direction.

Preferably, a lower plate is disposed within the base member for reciprocal movement with respect to the base member, the lower plate being rigidly fixed to the die. A spring member is disposed in a portion of the lower plate. A knockout pin is engaged with the spring member elastically connecting the lower plate and the knockout pin. The knockout pin extends though an aperture in the base member and an aperture in the die. The die is configured for engagement with the knockout pin. A knockout pad is supported on an upper end of the knockout pin above the die.

Preferably, a plurality of guide posts are supported on the base member and a support plate is supported by the guide posts for reciprocal movement downward toward the base member and upward away from the base member above the die. A pressure pad is supported under the support plate such that the pressure pad is configured to undergo limited reciprocal movement with respect to the support plate above the die. A second spring member is disposed between the support plate and the pressure pad urging the pressure pad away from the support plate.

Preferably, the lever mechanism includes a lever engaging surface formed on the lower plate and a pin extending downward from the annular ring, through an aperture formed in the base member. The pin is formed with a head at a lower end thereof. A lever is configured to pivot on a portion of the base member with a first end of the lever engagable with the lever engaging surface and a second end of the lever being engagable with the head of the pin.

Alternatively, the lever mechanism includes first and second lever engaging surface formed on the lower plate, and a pin extending downward from the annular ring through an aperture formed in the base member. The pin is formed with a recess at a lower end thereof. A lever is configured to pivot on a portion of the base member, a first end of the lever is engaged with the lower plate between the first and second lever engaging surfaces and a second end of the lever being engaged within the recess of the pin.

In accordance with another aspect of the present invention, a gear teeth forming apparatus for forming a plurality of gear teeth extending in an axial direction on an outer circumferential wall of a cylindrically shaped member includes a base member. A die is disposed above the base member. The die is supported for reciprocal movement downward toward the base member and upward away from the base member. The die is formed with a plurality of grooves on an outer circumferential surface thereof. A plurality of rollers are supported on the base and are freely rotatable with respect to the base. The rollers are disposed adjacent to the outer circumferential surface of the die, each of the rollers disposed adjacent to a corresponding one of the grooves. An annular ring is supported on the base and contacts a radial outer side of each of the rollers. The annular ring is configured for reciprocal movement with respect to the base. A lever mechanism is supported on the base member mechanically connecting the annular ring and the die such that in response to movement of the die in an upward direction with respect to the base member the annular ring is moved in a downward direction, and in response to movement of the die in a downward direction the annular member is moved in an upward direction.

Preferably, a lower plate disposed within the base member for reciprocal movement with respect to the base member, the lower plate being rigidly fixed to the die. A spring member is disposed in a portion of the lower plate. A knockout pin is engaged with the spring member elastically connecting the lower plate and the knockout pin. The knockout pin extends though an aperture in the base member and an aperture in the die. The die is configured for engagement with the knockout pin in response to compression of the spring member. A knockout pad is supported on an upper end of the knockout pin above the die.

Preferably, a plurality of guide posts are supported on the base member support plate is supported by the guide posts for reciprocal movement downward toward the base member and upward away from the base member above the die. A pressure pad is supported under the support plate such that the pressure pad is configured to undergo limited reciprocal movement with respect to the support plate above the die. A second spring member is disposed between the support plate and the pressure pad urging the pressure pad away from the support plate.

Preferably, the lever mechanism includes first and second lever engaging surface formed on the lower plate. A pin extends downward from the annular ring through an aperture formed in the base member. The pin is formed with a recess at a lower end thereof. A lever is configured to pivot on a portion of the base member. A first end of the lever is engaged with the lower plate between the first and second lever engaging surfaces and a second end of the lever is engaged within the recess of the pin.

In accordance with yet another aspect of the present invention, a gear teeth forming apparatus for forming a plurality of gear teeth extending in an axial direction on an outer circumferential wall of a cylindrically shaped member includes a base member. A die is disposed above the base member. The die is supported for reciprocal movement downward toward the base member and upward away from the base member. The die is formed with a plurality of grooves on an outer circumferential surface thereof. A plurality of rollers are supported on the base and freely rotatable with respect to the base. The rollers are disposed adjacent to the outer circumferential surface of the die, each of the rollers disposed adjacent to a corresponding one of the grooves. An annular ring is supported on the base which contacts a radial outer side of each of the rollers, the annular ring being configured for reciprocal movement with respect to the base. A lower plate is disposed within the base member for reciprocal movement with respect to the base member, the lower plate being rigidly fixed to the die. A spring member disposed in a portion of the lower plate. A knockout pin is engaged with the spring member elastically connecting the lower plate and the knockout pin. The knockout pin extends though an aperture in the base member and an aperture in the die. The die is configured for engagement with the knockout pin. A knockout pad is supported on an upper end of the knockout pin above the die. A lever mechanism is supported on the base member mechanically connecting the annular ring and the die such that in response to movement of the die in a first direction relative to the base member, the lever mechanism moves the annular ring in an opposite direction.

Preferably, the lever mechanism is mechanically connected the annular ring and the die such that in response to movement of the die in an upward direction with respect to the base member the annular ring is moved in a downward direction, and in response to movement of the die in a downward direction the annular member is moved in an upward direction.

Preferably, a plurality of guide posts are supported on the base member and a support plate is supported by the guide posts for reciprocal movement downward toward the base member and upward away from the base member above the die. A pressure pad is supported under the support plate such that the pressure pad is configured to undergo limited reciprocal movement with respect to the support plate above the die. A second spring member is disposed between the support plate and the pressure pad urging the pressure pad away from the support plate.

In the gear teeth forming apparatus, a plurality of the gear teeth are formed in the outer circumferential wall of a drum. Here, the gear teeth are attained by a simple press machine having a punch or the like. Also, since the working process is performed through one stroke, the number of the working steps may be reduced.

In the gear teeth forming apparatus, the outer circumferential wall of the pressed drum is depressed to each of the recess portions of the punch by a plurality of the rollers arranged radially outwardly of the punch. Thus, the gear teeth are formed.

In the gear teeth forming apparatus of the invention, although a radially outward force is applied to a plurality of the rollers while forming the gear teeth, radially outward that force is counteracted against by the annular backup ring. Thus, the rollers are confined and do not move in a radially outward direction and the gear teeth are formed in a regular or normal manner.

In the gear teeth forming apparatus of the invention, during the formation of teeth, the annular backup ring moves in a direction opposite to the movement direction of the punch. As a result, there is little friction or resistance between the rollers and the annular backup ring and the rollers may rotate smoothly.

In the gear teeth forming apparatus, removal of the work piece is made simpler and may be conducted with less effort due to the knockout pad which separates the work material from the die.

DESCRIPTION OF THE PREFERRED EMBODIMENTS

The present invention will now be described with reference to the accompanying drawings.

FIRST EMBODIMENT

Figure 1:
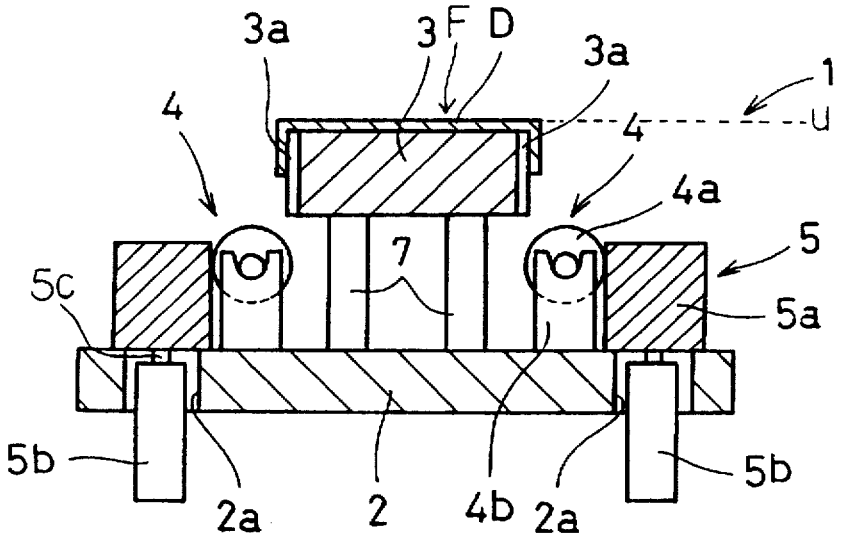
FIG. 1 is a schematic, cross-sectional side view of a gear tooth forming apparatus in accordance with a first embodiment of the present invention.
Figure 2:
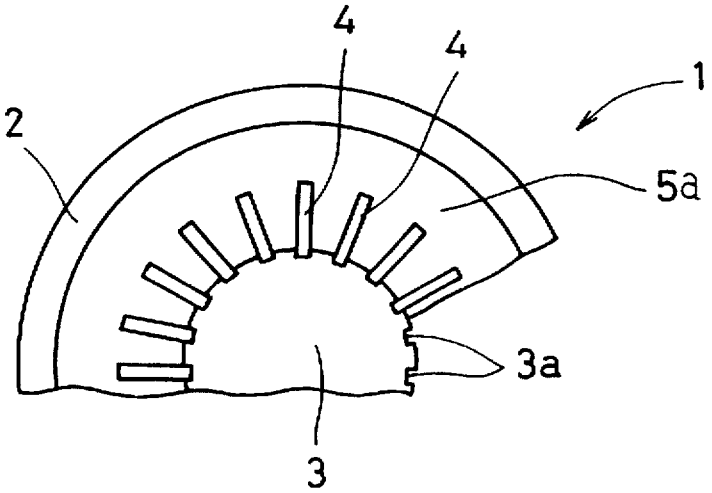
FIG. 2 is a fragmentary top elevational view showing the gear tooth forming apparatus depicted in FIG. 1.
Figure 3:
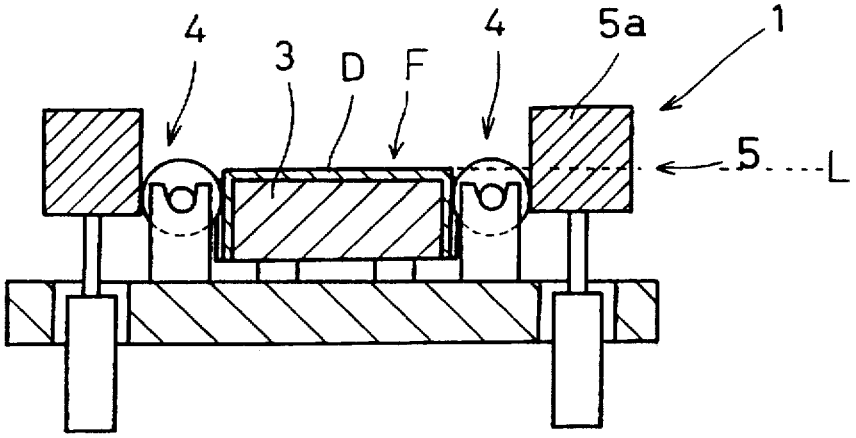
FIG. 3 is a view similar to the view of FIG. 1, showing a gear tooth forming operation as performed by the gear tooth forming apparatus shown in FIG. 1.

FIGS. 1, 2 and 3 show a gear tooth forming apparatus 1 according to a first embodiment of the invention. The gear teeth forming apparatus 1 includes a base 2, a punch 3, a roller mechanism 4 and a load receiving mechanism 5. The base 2 is formed with a disc-like shape and is formed with a plurality of holes 2*a*. The holes 2*a* are circumferentially spaced apart from one another at equidistant intervals in the circumferential direction on an outer circumferential side of the base 2. The punch 3 is a disc-shaped member and is centrally disposed above the upper surface of the base 2. Springs 7 are interposed between the punch 3 and the base 2, so that the punch 3 is movable up and down on the base 2. The springs 7 are provided to bias the punch 3 in an upper position U, as shown in FIG. 1. Furthermore, the punch 3 is configured to be moved downward by a force F from above (in FIG. 1) and moved to a lower position L, as shown in FIG. 1. 3. A plurality of grooves 3*a* are formed on the outer circumference of the punch 3 and are sized an configured to form any of a variety of predetermined gear shapes and gear forms, depending upon the desired results.

The roller mechanism 4 includes a plurality of rotational rollers 4*a* disposed radially outwardly from the punch 3. Each of the rollers 4*a* is supported on a support base 4*b*. Each of the rollers 4*a* may include a bearing (not shown) so that the rollers 4*a* may rotate freely on the support base 4*b*. The support base 4*b* is fixed to the base 2, and the rotational rollers 4*a* are positioned such that they are aligned with the grooves 3*a* of the punch 3.

The load receiving mechanism 5 includes a backup ring 5*a* and a plurality of slide receiving member 5*b* for supporting the backup ring 5*a* from below. Each of the slide receiving members 5*b* may be fixed to the base 2 or, alternatively, both the base 2 and the slide receiving members 5*b* may be fixed to a separate base member (not shown). Each of the slide receiving members 5*b* includes a sliding rod 5*c* which is freely slidable in and extendable from its corresponding slide receiving member 5*b*. Each of the slide receiving members 5*b* extends through the holes 2*a* of the base 2 so that each of the sliding rods 5*c* may extend through a corresponding hole 2*a*. The backup ring 5*a* is fixed to each of the sliding rods 5*c*. The inner circumferential surface of the backup ring 5*a* is sized and configured to be in contact with each of the rotational rollers 4*a*. The slide receiving members 5*b* are thus configured to supporting the backup ring 5*a* to be movable up and down with respect to the base 2.

A pressed drum D, which is to have gear teeth formed thereon, is set as shown in FIG. 1 on to the punch 3. Specifically, the outer circumferential wall of the drum D is fitted over the outer circumferential surface of the punch 3 thus extending over the grooves 3*a*. When a large force, such as the force F, is applied to the drum D and punch 3 from above, the punch 3 and drum D are moved downward with the drum D. The movement of the drum D downward causes the outer circumference of the drum to contact the rotational rollers 4*a*. Contact with the rotational rollers 4*a* causes the rotational rollers 4*a* to rotate and further, causing the drum D to be deformed as the rotation rollers 4*a* force corresponding portions of the outer circumferential wall of the drum D to into the grooves 3*a* of the punch 3. As a result, a plurality of gear teeth are formed in the pressed drum D to be machined. While the drum D is moving downward and gear teeth are formed thereon, the backup ring 5*a* of the load receiving mechanism 5 is moved upward due to contact with the rolling rotational rollers 4*a*. In other words, the backup ring 5*a* moves in response to rotation of the rotational rollers 4*a*. The backup ring 5*a* provides support to the rotational rollers 4*a*, preventing radial outward movement of the rotational rollers 4*a*. Since the backup ring 5*a* is freely movable up and down, there is little possibility that friction or resistance will be created which might hinder the rolling movement of the rotational rollers 4*a* and the backup ring 5*a*.

In the gear teeth forming apparatus 1, the gear teeth may be formed with a simple pressing machine including the punch 3 and the like. Also, since the working process is performed through one stroke, the number of the working steps may be reduced.

In the gear teeth forming apparatus for a pressed drum according to the first embodiment of the present invention, the gear teeth may be formed with a simple pressing machine including the punch and the like. Also, since the working process is performed through one stroke, the number of the working steps may be reduced.

SECOND EMBODIMENT

Figure 4:
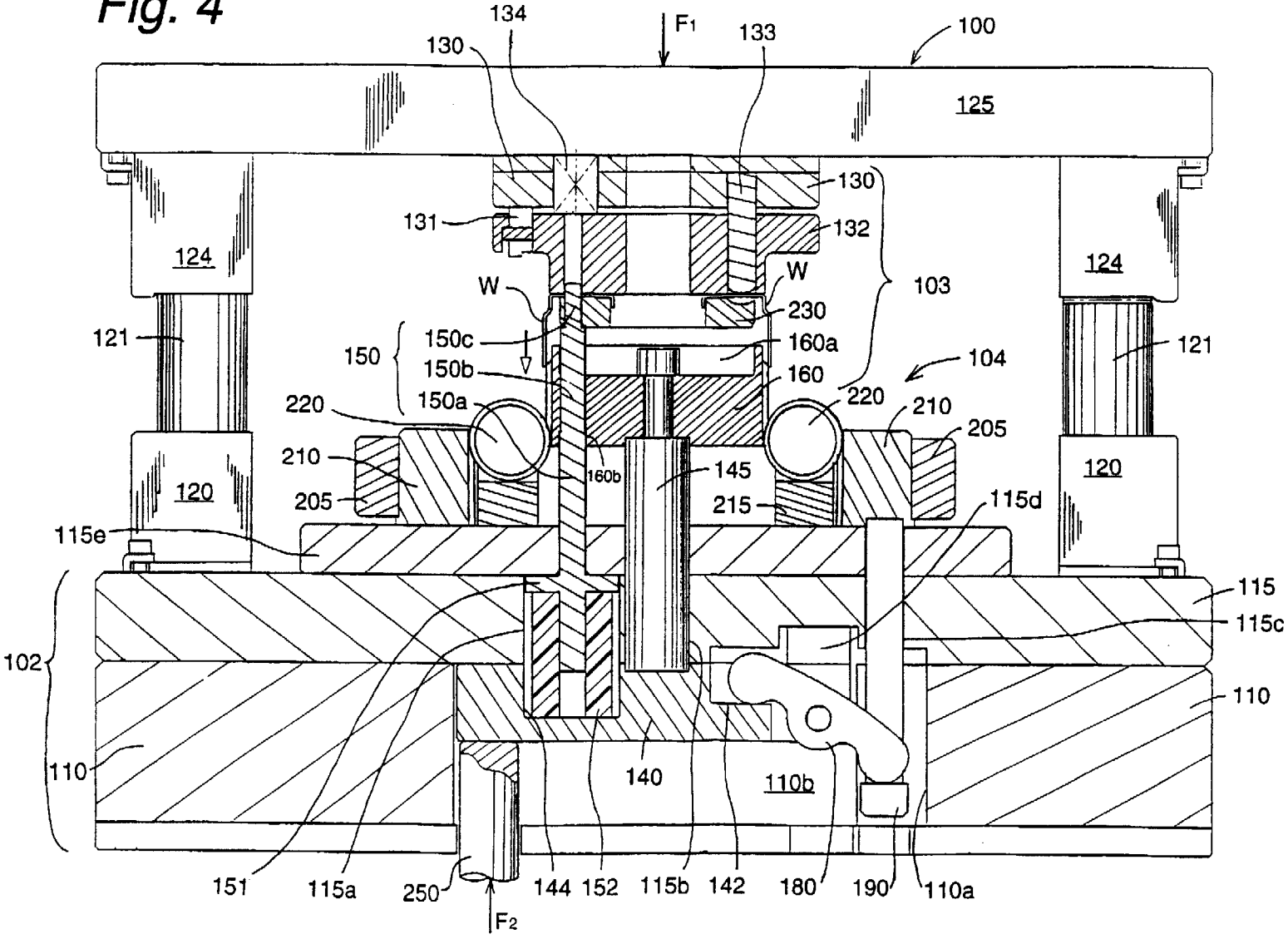
FIG. 4 is a partial cross section, part elevational side view of a gear tooth forming apparatus in accordance with a second embodiment of the present invention, shown in a first position with a work material installed awaiting gear teeth forming.
Figure 5:
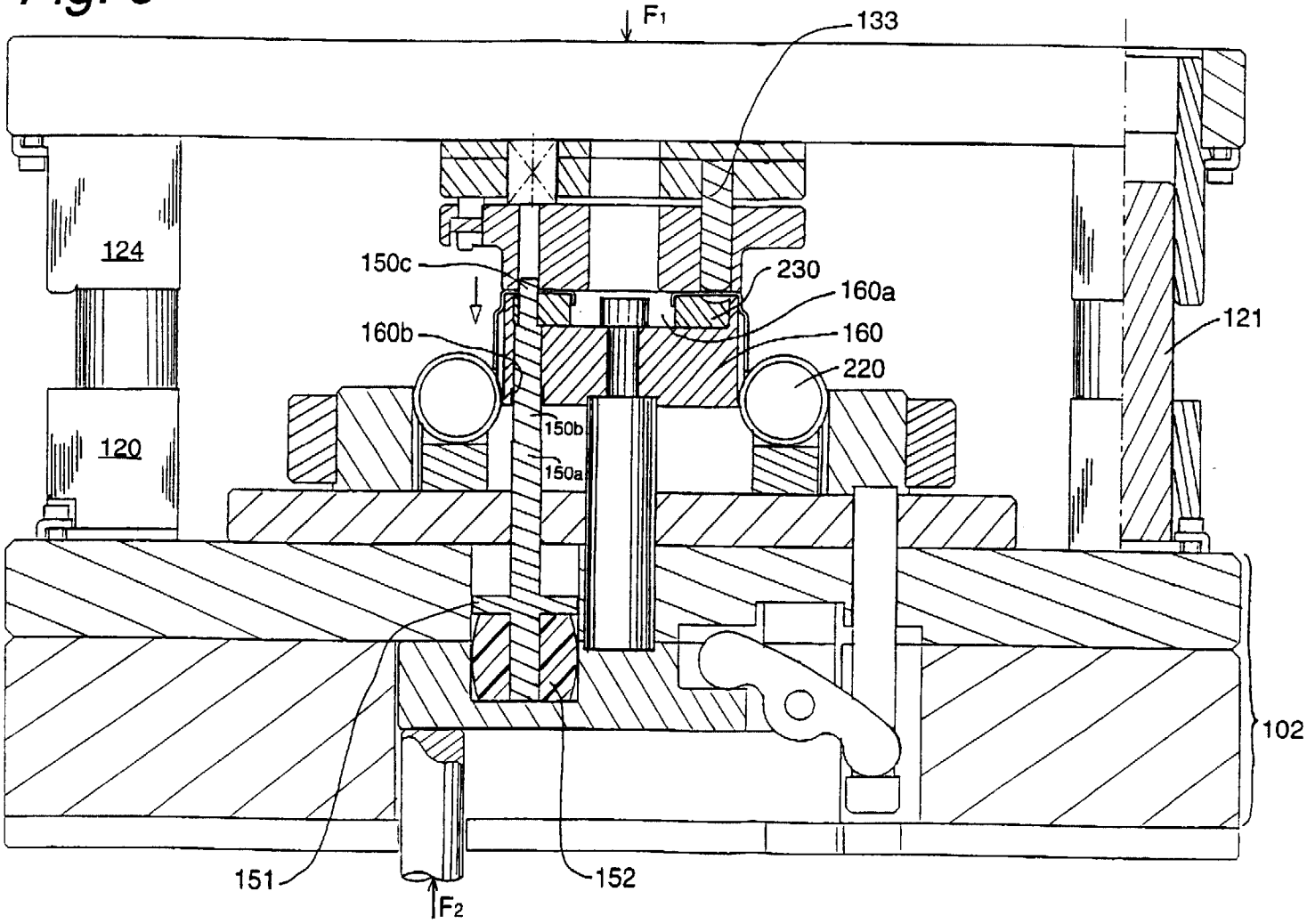
FIG. 5 is a partial cross section, part elevational side view of the gear tooth forming apparatus, similar to FIG. 4, but showing the second embodiment with the work material in an initial stage of gear teeth forming.
Figure 6:
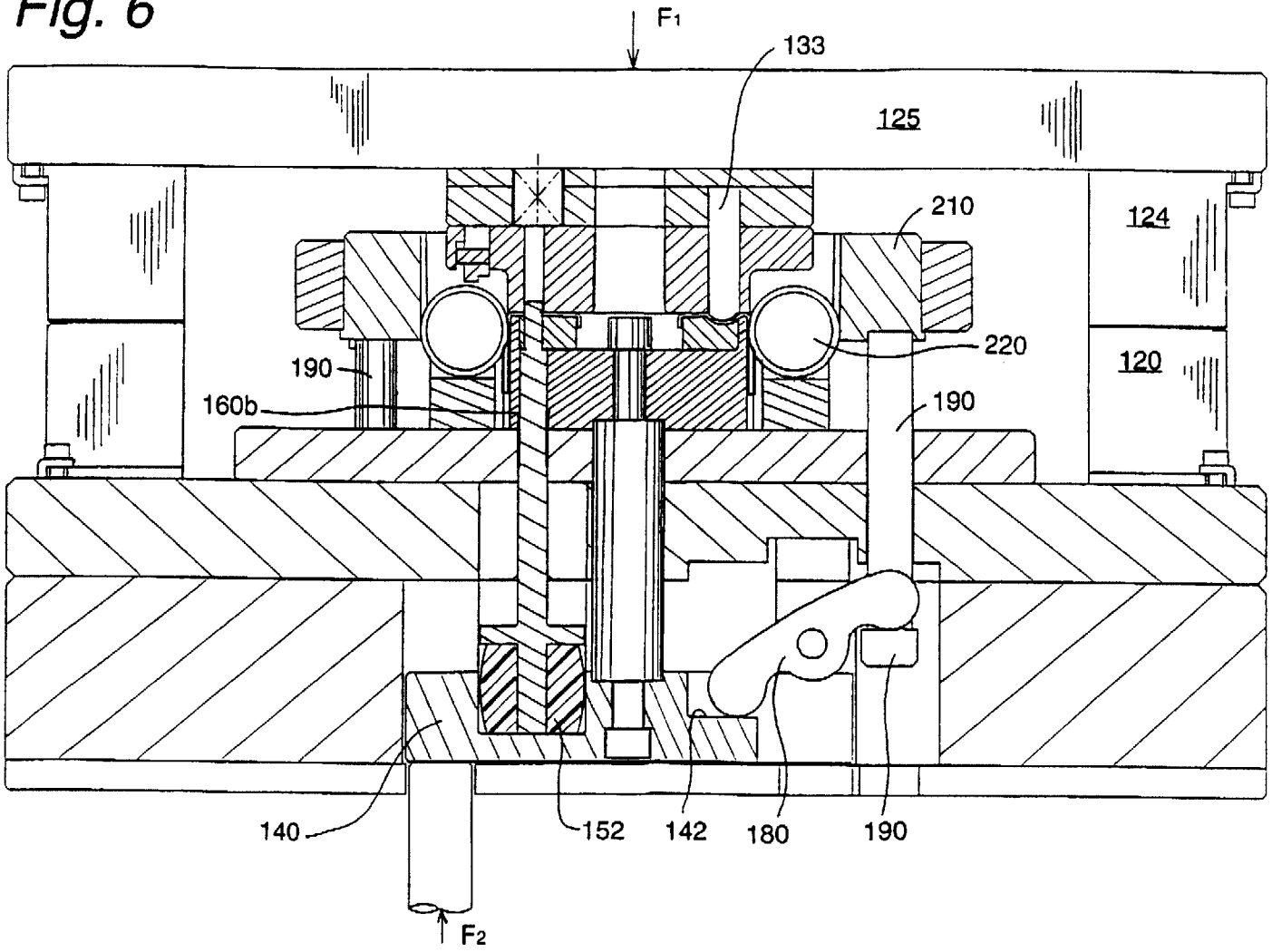
FIG. 6 is a partial cross section, part elevational side view of the gear tooth forming apparatus, similar to FIGS. 4 and 5, showing the second embodiment with the work material in a subsequent stage of gear teeth forming.

FIGS. 4, 5 and 6 show a gear tooth forming apparatus 100 according to a second embodiment of the present invention. The gear teeth forming apparatus 100 includes a base 102, a punch mechanism 103 and a roller mechanism 104. The base 102 is preferably formed with a circular, disc-like shape and includes a block 110. The block 110 is formed with a plurality of recesses 110*a*, although only one recess 110*a* is shown in the drawings. The block 110 is also formed with a central bore 110*b*. The base 102 also includes a base plate 115 which is formed with a plurality of apertures 115*a*, a single central aperture 115*b* and a plurality of apertures 115*c*. In FIGS. 4, 5 and 6 only one of each of the apertures 115*a* and 115*c* are depicted. Since the base 102 has a disc-like shape, it should be understood that the apertures 115*a* and 115*c* are circumferentially spaced apart from one another about the aperture 115*b*.

On the upper surface of the base plate 115, a plurality of stop blocks 120 are mounted. The stop blocks 120 are circumferentially spaced apart with respect to the base plate 115, although only two stop blocks 120 are depicted to provide greater clarity. Above the base plate 115 is an upper support plate 125. A plurality of stop blocks 124 are mounted to the underside of the upper support plate 125, corresponding to the stop blocks 120. The stop blocks 120 and 124 form corresponding pairs having a guide post 121 extending therebetween. Each guide post 121 is fixed with respect to the stop block 120, but may slide within a bore formed in the stop block 124. Details of the guide post 121 and the stop blocks 120 and 124 are shown at the right hand side of FIG. 5 in cross section. The upper support plate 125 is moveable up and down with the guide posts 121 sliding within the stop blocks 124.

The punch mechanism 103 includes a support plate 130 that is attached to the upper support plate 125 by, for instance, bolts (not shown). The support plate 130 includes a plurality of alignment pins 131 which extend downwardly from the support plate 130. A pressure pad 132 is supported under the support plate 130 by the alignment pins 131 such that the pressure pad 132 is moveable up and down (relative to the orientation in FIGS. 4, 5 and 6) with respect to the support plate 130 along the length of the alignment pins 131.

The pressure pad 132 is limited to movement, relative to the support plate 130, between the position of the pressure pad 132 shown in FIG. 4 to the position shown in FIG. 6. Specifically, in FIG. 4, the pressure pad 132 is spaced apart from the support plate 130 and in FIG. 6, the pressure pad 132 is in contact with the underside of the support plate 130. Although only one alignment pin 131 is shown, there are several alignment pins 131 circumferentially spaced apart from one another. A spring member 134 is disposed in a corresponding aperture formed in the support plate 130. The spring member 134 engages the pressure pad 132 and biases the pressure pad 132 into the position shown in FIG. 4 away from the support plate 130. A punch pin 133 also extends from the support plate 130 through a corresponding aperture in the pressure pad 132, as is explained in detail below.

The punch mechanism 103 also includes a lower plate 140 which is disposed in the central bore 110*b* of the block 110. The lower plate 140 is formed with a recess 144 and a lever recess having a lever contacting surface 142. A link pin 145 is fixed to the lower plate 140 by, for instance, a bolt (not shown). A knockout pin 150 extends from the from the recess 144 upward though the aperture 115*a*, through a die 160 (described below) and through a knockout pad 170 (described below). The lower portion of the knockout pin 150 includes a flange 151 which contacts the upper portion of a spring member 152. The spring member 152 is disposed in the recess 144. The spring member 152 is preferably composed of an elastic material such as rubber. However, the spring member 152 could also be a coil spring or other resilient body.

A lever 180 is disposed on a support 115*d*. The support 115*d* is fixed to the base plate 115. The lever 180 is free to rotate with respect to the support 115*d*. One end of the lever 180 engages the lever contacting surface 142. The other end of the lever 180 engages a pin 190, which is described in greater detail below.

The roller mechanism 104 includes a backup ring 205, a roller ring 210, roller supports 215, and rollers 220. A secondary base plate 115*e* is fixed to the base plate 115 by, for instance bolts (not shown). The roller supports 215 are fixed to the secondary base plate 115*e*. The rollers 220 are mounted on the roller supports 215 such that the rollers 220 are free to rotate on the roller supports 215. The roller ring 210 is formed with grooves corresponding to the rollers 220. The backup ring 205 is disposed circumferentially about the roller ring 210 providing annular support.

It should be understood that there are a plurality of the pins 190 circumferentially disposed about the link pin 145, where the link pin 145 generally defines the center of the gear tooth forming apparatus 100. However, only one link pin 145 is shown for clarity. There are also a plurality of knockout pins 150, but only one shown for clarity.

An upper end of the link pin 145 engages and is fixed to the die 160. The die 160 is formed with a plurality of grooves corresponding to the rollers 220 and the grooves formed in the roller ring 210. The die 160 is also formed with an aperture through which the knockout pin 150 extends. The aperture in the die 160 is formed with two separate diameters, and a stop surface 160*b* is defined between the two separate diameters of the aperture.

The knockout pin 150 has an elongated shaft with three separate sections, each section having a different diameter. A lower section 150*a* of the knockout pin 150 has a relatively large diameter. A mid section 150*b* of the knockout pin 150 has diameter smaller than the lower section 150*a* and an upper section 150*c* has a still smaller diameter. The upper portion of the aperture in the die 160 has a diameter generally equal to the diameter of the mid section 150*b*, but has a larger diameter below the stop surface 160*b* thus restricting movement of the knockout pin 150 with respect to the movement of the die 160. The knockout pin 150 also extends through an aperture in the secondary base plate 115*e*. The aperture in the secondary base plate 115*e* is generally the same size as the lower section 150*a*.

A knockout pad 230 is disposed between the pressure pad 132 and the die 160. The knockout pad 230, like the pressure pad 132 and the die 160, is a circular or annular shaped member. The upper section 150*c* extends through apertures formed in the knockout pad 230, where the apertures formed in the knockout pad 230 are smaller than the diameter of the mid section 150*b* thus supporting the knockout pad 230. A piece of work material W having an inverted cup-like shape is disposed on the knockout pad 230, as shown in FIGS. 4, 5 and 6. There are a plurality of knockout pins 150, as stated above, each of the knockout pins 150 have an upper section 150*c* supporting the knockout pad 230. However, only one knockout pin 150 and one upper section 150*c* is shown to provide greater clarity in the drawings.

The pin 190 is attached to a lower surface of the roller ring 210. The pin 190 has a head formed on its lower end which contacts a portion of the lever 180, as shown in FIGS. 4, 5 and 6. The pin 190 extends through the aperture 115*c* and is basically free to move through the aperture 115*c* in response to movement of the roller ring 210, but is constrained from moving by engagement of a head formed at the bottom of the pin 190 with the lever 180. Specifically, with the lower plate 140 in the position shown in FIG. 4, the lever 180 is constrained from movement by the surface 142 of the lower plate 140, and the lever 180 prevents upward movement of the pin 190 and hence prevents movement of the roller ring 210.

The operation of the gear tooth forming apparatus 100 will now be described with respect to FIGS. 4, 5 and 6.

A work material W is first installed onto the knockout pad 230. The upper support plate 125 may be raised to a position higher with respect to the base plate 115 than is shown in FIG. 4 to facilitate installation of the work material W. The work material W is preferably a workable metallic material onto which gear teeth are to be formed. In an unworked state, the work material W has a cylindrical, cup-like shape, with an upper generally flat portion thereof being engaged between the knockout pad 230 and the support plate 230. At least one aperture is preformed in the work material W through which the upper section 150*c* of the knockout pin 150 extends.

A force $F_1$ is thereafter applied to the upper support plate 125. In response to the force $F_1$, stop blocks 124 move downward with the guide posts 121 extending further into the apertures formed in the stop blocks 124, as is depicted in FIG. 5. Also in response to the force $F_1$, the knockout pad 230 begins to move downward and into a recess 160*a* formed in the die 160, as is also depicted in FIG. 5. The force $F_1$ is also transmitted through the pressure pad 132 to the knockout pin 150. Movement of the knockout pin 150 compresses the spring member 152 which stores the energy due to compression for later use, as is explained below. The mid section 150*b* of the knockout pin 150 moves downward as well, separating from the stop surface 160*b* formed in the die 160. Once the knockout pad 230 has moved completely into the recess 160*a*, as shown in FIG. 5, then the die 160 begins to move downward as well.

Further applied force $F_1$ also causes the spring member 134 to be compressed between the support plate 130 and the pressure pad 132, where the pressure pad 132 is able to move with respect to the support plate 130 along the length of the alignment pins 131. The stored energy in the compressed spring member 134 is used later, as is explained below. Further, the punch pin 133 is forced into the work material W forming a dimple in the work material W or alternatively, may punch a hole in the work material W, depending on the design criteria of desired final product to be produced from the work material W.

Looking now at FIGS. 5 and 6, further force $F_1$ applied to the upper support plate 125 causes the work material W to engage the rollers 220. Thereafter, further movement of the upper support plate 125 downward causes work material W to be forced between the rollers 220 and the grooves formed in the die 160. Downward movement of the work material W after engagement with the rollers 220 causes the rollers 220 to rotate. The rollers 220 deform the work material W, pressing corresponding portions of the work material W against the surfaces of the die 160. Gear teeth are formed in the work material W as a result. The rollers 220 are confined between the work material W and the roller ring 210 and therefore, as rollers 220 rotate in accordance with movement of the work material W, the roller ring 210 moves upward in response to rotation of the rollers 220.

Movement of the die 160 downward also causes the link pin 145 and the lower plate 140 to move downward accordingly. Movement of the lower plate 140 also allows for movement of the lever 180 and upward movement of the pin 190. Thus, the roller ring 210 and backup ring 215 are able to move upward generally freely as the rollers 220 roll against the work material W with the die 160 moving downward.

As shown in FIG. 6, the movement of the upper support plate 125 is limited by the size and configuration of the stop blocks 120 and 124. In FIG. 6, further movement of the upper support plate 125 is prevented by engagement between the stop blocks 120 and 124. The roller ring 210 and backup ring 215 are in an upper most position with the rollers 220 having rotated in accordance with downward movement of the work material W on the die 160.

During the downward movement of the upper support plate 125, an upward force $F_2$ is continuously applied to the lower plate 140 by die cushioning pins 250. The die cushioning pins 250 extend out from a force applying mechanism, such as pneumatic cylinders (not shown) which apply a generally compressible force compared to the force $F_1$. Thus, when the $F_1$ is removed, the force $F_2$ pushes the lower plate 140 upward. The upward movement of the lower plate 140 causes the link pin 145 to push the die 160 upward, and also causes the lever contacting surface 142 to engage the lever 180. Engagement of the lever 180 causes the pin 190 to be moved downward, thus pulling the roller ring 210 and the backup ring 205 downward in synchronous movement with the upward movement of the lower plate 140 and the die 160. During upward movement of the die 160, the rollers 220 are forced to re-roll against the surfaces of the work material W thus again contacting the newly formed gear teeth to assure proper formation of the gear teeth. Synchronous downward movement of the roller ring 210 with rotation of the rollers 220 and the upward movement of the die 160 assures reliable re-rolling.

In some instances, although a material has been deformed by a process such as that described above, the work material W may spring back or partially recover from initial deformation. Therefore, the re-rolling process insures generally consistent deformation of the work material W. The lever 180 assures that the roller ring 210 and the backup ring 205 move downward as the die moves upward to facilitate smooth re-rolling.

As the force $F_1$ is released from the upper support plate 125, several other things happen as well in addition to that described above. For instance, the force of the spring member 134 causes the pressure pad 132 to separate from the support plate 130 releasing the pressure the punch pin 133 exerts on the work material W. Further, the force stored in the spring member 152 causes the knockout pin 150 to move upward, thus urging the knockout pad 230 out of the recess 160*a* of the die 160, and further urging the now deformed work material W off of the die 160. It should be appreciated that the connection between the link pin 145 and the die 160 prevents the die 160 from moving upward beyond the position shown in FIG. 4, thus making it possible to easily urge the knockout pad 230 out of the recess 160*a*.

In the above described second embodiment, the lever 180 only contacted a single surface of the lower plate 140, specifically, the lever contacting surface 142. In the second embodiment, with the lower plate 140 in a lower position, such as is shown in FIG. 6, the position of the lever 180 has no restricting effects on the movement of the pin 190 and hence the movement of the roller ring 210. If the roller ring 210 has moved into an upper position, such as that shown in FIG. 6, then the lever 180 only effects the position of the pin 190 and the roller ring 210 as the lower plate 140 moves back to an upper position, such as is shown in FIG. 4. In other words, the lever 180 in the second embodiment only insures downward movement of the roller ring 210 with the upward movement of the lower plate 140. Only rolling engagement between the rollers 220 and the roller ring 210 causes upward movement of the roller ring 210 in the second embodiment.

THIRD EMBODIMENT

Figure 7:
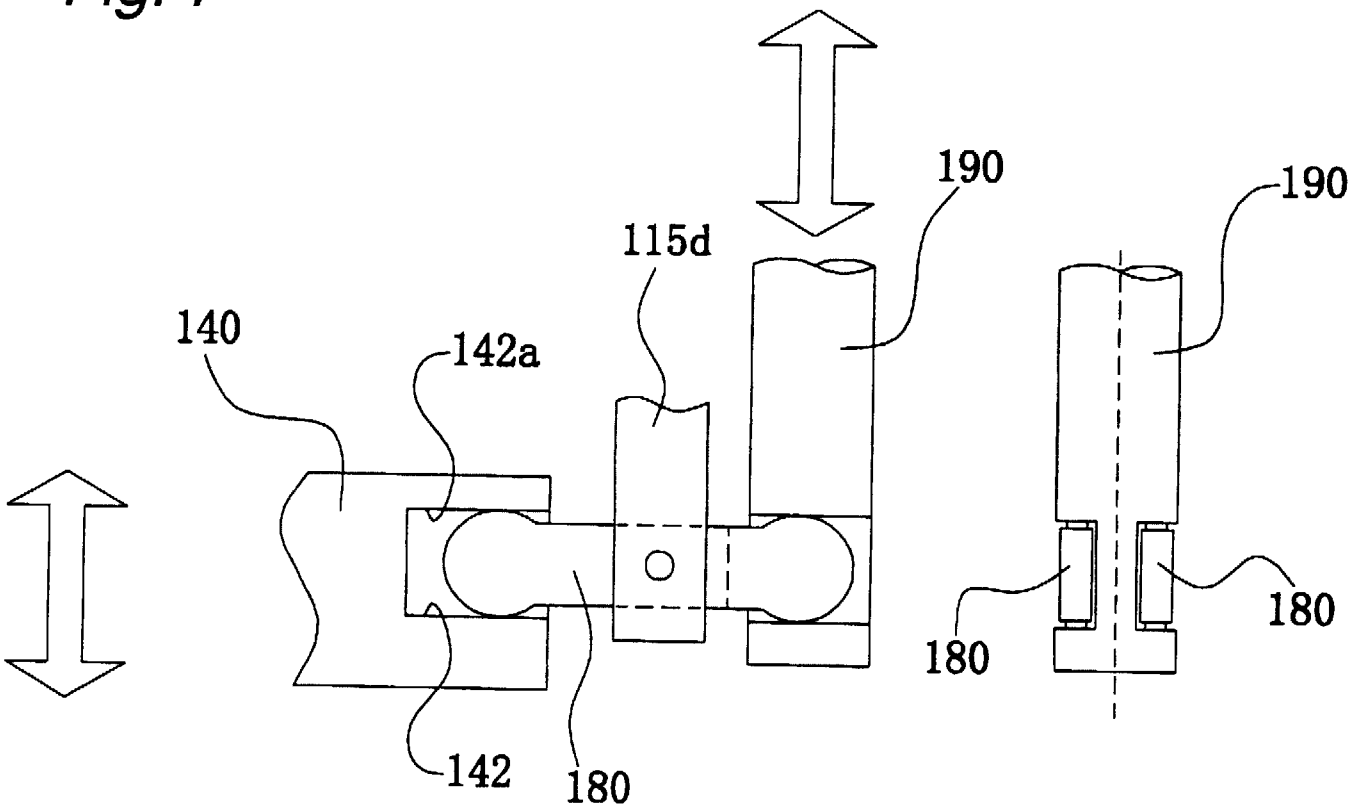
FIG. 7 is a fragmentary elevation view of portions of a gear tooth forming apparatus in accordance with a third embodiment of the present invention.

In a third embodiment of the invention, shown in FIG. 7, the lower plate 140 may be formed with a recess having a first lever contacting surface 142 and a second lever contacting surface 142*a* which confine movement of the lever 180 in both upward and downward directions. Further, the pin 190, in the third embodiment, is formed a corresponding recess which constrains both upward and downward movement of the pin 190 with respect to the lever 180.

In the third embodiment, the configuration of the pin 190, the lever contacting surfaces 142 and 142*a*, and the lever 180 force synchronous movement of the die 160 and the roller ring 210. In other words, as the die 160 moves in an downward direction, the roller ring 210 moves synchronously in an upward direction. As well, as the die 160 moves in an upward direction, the roller ring 210 moves synchronously in an downward direction.

Various details of the invention may be changed without departing from its spirit nor its scope. Furthermore, the foregoing description of the single embodiment according to the present invention is provided for the purpose of illustration only, and not for the purpose of limiting the invention. The invention may be defined suitably by the appended claims and may include possible equivalent thereof.

What we claim is:

1. A gear teeth forming apparatus for forming a plurality of gear teeth extending in an axial direction on an outer circumferential wall of a cylindrically shaped member comprising;

a base member;

a die disposed above said base member for reciprocal movement downward toward said base member and upward away from said base member, said die formed with a plurality of grooves on an outer circumferential surface thereof;

a plurality of rollers supported on said base and freely rotatable with respect to said base, said rollers disposed adjacent to said outer circumferential surface of said die, each of said rollers disposed adjacent to a corresponding one of said grooves;

an annular ring supported on said base which contacts a radial outer side of each of said rollers, said annular ring being configured for reciprocal movement with respect to said base;

a lower plate disposed within said base member for reciprocal movement with respect to said base member, said lower plate being rigidly fixed to said die;

a spring member disposed in a portion of said lower plate;

a knockout pin engaged with said spring member elastically connecting said lower plate and said knockout pin, said knockout pin extending though an aperture in said base member and an aperture in said die, said die configured for engagement with said knockout pin;

a knockout pad supported on an upper end of said knockout pin above said die; and a lever mechanism supported on said base member mechanically connecting said annular ring and said die such that in response to movement of said die in a first direction relative to said base member, said lever mechanism moves said annular ring in an opposite direction.

2. The gear teeth forming apparatus as set forth in claim 1, wherein said lever mechanism is mechanically connecting said annular ring and said die such that in response to movement of said die in an upward direction with respect to said base member said annular ring is moved in a downward direction, and in response to movement of said die in a downward direction said annular ring is moved in an upward direction.

3. The gear teeth forming apparatus as in claim 1 further comprising:

a plurality of guide posts supported on said base member;

a support plate supported by said guide posts for reciprocal movement downward toward said base member and upward away from said base member above said die;

a pressure pad supported under said support plate such that said pressure pad is configured to undergo limited reciprocal movement with respect to said support plate above said die; and a second spring member disposed between said support plate and said pressure pad urging said pressure pad away from said support plate.

4. A gear teeth forming apparatus for forming a plurality of gear teeth extending in an axial direction on an outer circumferential wall of a cylindrically shaped member comprising;

a base member;

a die disposed above said base member for reciprocal movement downward toward said base member and upward away from said base member, said die formed with a plurality of grooves on an outer circumferential surface thereof;

a plurality of rollers supported on said base and freely rotatable with respect to said base, said rollers disposed adjacent to said outer circumferential surface of said die, each of said rollers disposed adjacent to a corresponding one of said grooves;

an annular ring supported on said base which contacts a radial outer side of each of said rollers, said annular ring being configured for reciprocal movement with respect to said base; and a lever mechanism supported on said base member mechanically connecting said annular ring and said die such that in response to movement of said die in an upward direction with respect to said base member said annular ring is moved in a downward direction, and in response to movement of said die in a downward direction said annular ring is moved in an upward direction.

5. The gear teeth forming apparatus as in claim 4 further comprising:

a lower plate disposed within said base member for reciprocal movement with respect to said base member, said lower plate being rigidly fixed to said die;

a spring member disposed in a portion of said lower plate;

a knockout pin engaged with said spring member elastically connecting said lower plate and said knockout pin, said knockout pin extending though an aperture in said base member and an aperture in said die, said die configured for engagement with said knockout pin; and a knockout pad supported on an upper end of said knockout pin above said die.

6. The gear teeth forming apparatus as in claim 5, further comprising:

a plurality of guide posts supported on said base member;

a support plate supported by said guide posts for reciprocal movement downward toward said base member and upward away from said base member above said die;

a pressure pad supported under said support plate such that said pressure pad is configured to undergo limited reciprocal movement with respect to said support plate above said die; and a second spring member disposed between said support plate and said pressure pad urging said pressure pad away from said support plate.

7. The gear teeth forming apparatus as in claim 5, wherein said lever mechanism comprises:

first and second lever engaging surface formed on said lower plate;

a pin extending downward from said annular ring through an aperture formed in said base member, said pin formed with a recess at a lower end thereof; and a lever configured to pivot on a portion of said base member, a first end of said lever engaged with said lower plate between said first and second lever engaging surfaces and a second end of said lever being engaged within said recess of said pin.

8. A gear teeth forming apparatus for forming a plurality of gear teeth extending in an axial direction on an outer circumferential wall of a cylindrically shaped member comprising;

a base member;

a die disposed above said base member for reciprocal movement downward toward said base member and upward away from said base member, said die formed with a plurality of grooves on an outer circumferential surface thereof;

a plurality of rollers supported on said base and freely rotatable with respect to said base, said rollers disposed adjacent to said outer circumferential surface of said die, each of said rollers disposed adjacent to a corresponding one of said grooves;

an annular ring supported on said base which contacts a radial outer side of each of said rollers, said annular ring being configured for reciprocal movement with respect to said base; and a lever mechanism supported on said base member mechanically connecting said annular ring and said die such that in response to movement of said die in a first direction relative to said base member, said lever mechanism moves said annular ring in an opposite direction.

9. The gear teeth forming apparatus as set forth in claim 8, wherein said lever mechanism is mechanically connecting said annular ring and said die such that in response to movement of said die in an upward direction with respect to said base member said annular ring is moved in a downward direction, and in response to movement of said die in a downward direction said annular ring is moved in an upward direction.

10. The gear teeth forming apparatus as in claim 8 further comprising:

a lower plate disposed within said base member for reciprocal movement with respect to said base member, said lower plate being rigidly fixed to said die;

a spring member disposed in a portion of said lower plate;

a knockout pin engaged with said spring member, elastically connecting said lower plate and said knockout pin, said knockout pin extending though an aperture in said base member and an aperture in said die, said die configured for engagement with said knockout pin; and a knockout pad supported on an upper end of said knockout pin above said die.

11. The gear teeth forming apparatus as in claim 10, further comprising:

a plurality of guide posts supported on said base member;

a support plate supported by said guide posts for reciprocal movement downward toward said base member and upward away from said base member above said die;

a pressure pad supported under said support plate such that said pressure pad is configured to undergo limited reciprocal movement with respect to said support plate above said die; and a second spring member disposed between said support plate and said pressure pad urging said pressure pad away from said support plate.

12. The gear teeth forming apparatus as in claim 9, wherein said lever mechanism comprises:

a lever engaging surface formed on said lower plate;

a pin extending downward from said annular ring, through an aperture formed in said base member, said pin formed with a head at a lower end thereof; and a lever configured to pivot on a portion of said base member, a first end of said lever engagable with said lever engaging surface and a second end of said lever being engagable with said head of said pin.

13. The gear teeth forming apparatus as in claim 9, wherein said lever mechanism comprises:

first and second lever engaging surface formed on said lower plate;

a pin extending downward from said annular ring through an aperture formed in said base member, said pin formed with a recess at a lower end thereof; and a lever configured to pivot on a portion of said base member, a first end of said lever engaged with said lower plate between said first and second lever engaging surfaces and a second end of said lever being engaged within said recess of said pin.

* * * * *